US010376763B2

(12) United States Patent
Crosby et al.

(10) Patent No.: US 10,376,763 B2
(45) Date of Patent: Aug. 13, 2019

(54) NET SYSTEM WITH FINE HEIGHT ADJUSTMENT

(71) Applicant: Gared Holdings, LLC, Noblesville, IN (US)

(72) Inventors: William D. Crosby, Greenwood, IN (US); Kevin R. Needler, Fishers, IN (US); James J. Connerley, Noblesville, IN (US)

(73) Assignee: Gared Holdings, LLC, Noblesville, IN (US)

( * ) Notice: Subject to any disclaimer, the term of this patent is extended or adjusted under 35 U.S.C. 154(b) by 46 days.

(21) Appl. No.: 15/290,341

(22) Filed: Oct. 11, 2016

(65) Prior Publication Data

US 2018/0099192 A1 Apr. 12, 2018

(51) Int. Cl.

| | |
|---|---|
| ***A63B 61/00*** | (2006.01) |
| ***A63B 61/02*** | (2006.01) |
| ***A63B 61/04*** | (2006.01) |
| ***A63B 71/02*** | (2006.01) |
| ***A63B 102/02*** | (2015.01) |

(52) U.S. Cl.

CPC ..... *A63B 61/02* (2013.01); *A63B 61/003* (2013.01); *A63B 61/04* (2013.01); *A63B 2071/025* (2013.01); *A63B 2102/02* (2015.10); *A63B 2225/093* (2013.01); *A63B 2243/0095* (2013.01)

(58) Field of Classification Search

CPC ..... A63B 61/02; A63B 61/04; A63B 61/003; A63B 2243/0095; A63B 2225/093

See application file for complete search history.

(56) References Cited

U.S. PATENT DOCUMENTS

| | | | | |
|---|---|---|---|---|
| 1,641,246 | A | 9/1927 | Bassford | |
| 3,509,926 | A * | 5/1970 | Morris | B26D 1/25 83/648 |
| 4,122,451 | A | 10/1978 | Senoh | |
| 4,185,360 | A | 1/1980 | Prete, Jr. et al. | |
| 4,324,022 | A | 4/1982 | Prete, Jr. | |
| 4,444,397 | A | 4/1984 | Kaburagi et al. | |
| 4,674,389 | A | 6/1987 | Fender | |
| 4,687,170 | A * | 8/1987 | Beaver | F16C 11/103 248/183.2 |
| 4,844,477 | A | 7/1989 | Pardi | |
| 5,224,675 | A * | 7/1993 | Ellenberger | F16M 11/10 248/183.4 |

(Continued)

*Primary Examiner* — Melba Bumgarner
*Assistant Examiner* — Amir A Klayman
(74) *Attorney, Agent, or Firm* — Brinks Gilson & Lione

(57) ABSTRACT

A net system used for example a sports game and a fine height adjustment system is provided. A cable mount is coupled to one or both of the upright posts with coarse height adjustment. A cable system for supporting the net includes a first end coupled to the upright post, and a second end coupled to a tension system of the other upright post. An intermediate portion of the cable system is slidably coupled along a pivoting member of the cable mount. The cable mount includes the fine height adjustment system that is coupled to the pivoting member. The pivoting member is pivotable in an upward direction or a downward direction upon movement of the fine height adjustment system without relieving tension from the cable system. The total distance of travel provided by fine height adjustment may be less than an incremental distance with coarse height adjustment.

24 Claims, 6 Drawing Sheets

(56) References Cited

U.S. PATENT DOCUMENTS 5,238,251 A * 8/1993 Staka ..... A63B 69/0095 473/429
5,316,315 A 5/1994 Roark, Jr.
5,320,416 A * 6/1994 Kornberg ..... A61G 5/10 297/467
5,330,199 A 7/1994 Vand
5,358,257 A * 10/1994 Pardi ..... A63B 61/02 473/493
5,467,552 A * 11/1995 Cupp ..... F41G 1/26 42/125
5,672,835 A 9/1997 Doughty
5,860,877 A 1/1999 Esser
5,951,417 A 9/1999 Ha
6,148,739 A * 11/2000 Martin ..... A47B 21/0314 108/50.01
6,375,369 B1 * 4/2002 Schneider ..... G03B 17/02 348/143
6,762,790 B1 * 7/2004 Matko ..... B60R 11/04 250/239
6,800,043 B1 * 10/2004 Pohrer ..... A63B 61/02 473/422
7,399,243 B2 * 7/2008 Schank ..... A63B 61/02 473/492
7,448,970 B2 11/2008 Li
7,841,570 B2 * 11/2010 Mileos ..... A47B 21/0314 108/138
8,240,075 B1 * 8/2012 Mullin ..... F41G 11/003 42/119
8,516,877 B2 * 8/2013 Le ..... G01N 3/303 248/127
9,823,045 B2 * 11/2017 Chu ..... F41B 5/12
2004/0262477 A1 * 12/2004 Whitaker ..... A47B 21/0314 248/284.1
2006/0073922 A1 4/2006 Stambaugh
2007/0054759 A1 * 3/2007 Nye ..... A63B 63/083 473/481

* cited by examiner

NET SYSTEM WITH FINE HEIGHT ADJUSTMENT

BACKGROUND

The present disclosure generally relates to a system and apparatus for supporting a net used for sports, such as a volleyball net. It includes, but is not limited to, uprights having a net tensioning assembly and height adjustment assemblies.

Games using a net, such as volleyball, are popular across the world. The net in such games typically must be maintained at a predetermined height and tension. Volleyball standard systems are designed to accomplish the task of rigidly supporting the volleyball net at a particular height. These systems typically include two upright vertical posts placed at either end of the volleyball net and secured to the ground. The upright posts are vertically adjustable in order to place the net at the particular height. In order to adjust the height of the volleyball net, the user must relieve the tension from the net prior to making such adjustments and re-tension the net afterwards. Changing the net height in this manner to achieve a precise net height can be time consuming.

SUMMARY

In one example, a net system, such as a sports net system, is provided. The system includes a first upright post and a second upright post. The second upright post includes a tension system and a cable mount. The cable mount includes a mount base coupled to the second upright post and a pivoting member pivotably coupled to the mount base. A cable system includes a first end coupled to the first upright post, and a second end coupled to the tension system. An intermediate portion of the cable system, disposed between the first end and second end of the cable system, is slidably engaged with the pivoting member of the cable mount. The cable mount includes a fine height adjustment system coupled to the pivoting member. The pivoting member is pivotable in an upward direction or a downward direction upon movement of the fine height adjustment system to adjust a height of the cable system.

In another example, a net system includes a pair of upright posts. One of the upright posts includes a first cable mount. The other of the upright posts includes a tension system and a second cable mount. Each cable mount includes a mount base coupled to the corresponding upright post and a pivoting member pivotably coupled to the mount base. A cable system supports a net along a ground base. The cable system includes a first end coupled to the first cable mount, and a second end coupled to the tension system. The tension system is configured to place the cable system in a fully tensioned configuration, wherein an intermediate portion of the cable system between the first end and the second end is slidably engaged with the pivoting member of the second cable mount. Each upright post includes a first height adjustment system configured to alter a vertical height of the cable system by first incremental distances. Each cable mount includes a second height adjustment system configured to alter the vertical height of the cable system by second incremental distances, where the total distance of adjustment achieved by the second height adjustment system is less than or equal to one of the first incremental distances.

In another example, a fine height adjustment system for a net is disclosed. The net is suspendable between a pair of upright posts and a cable system is coupled to the net and extendable between the upright posts. The system includes a mount base, a pivoting member, and an adjuster. The mount base is to couple to the upright post. The pivoting member includes a free end and an opposite, pivot end pivotably coupled to the mount base. The free end is to be in a contacting relationship with a portion of the cable system. The adjuster is coupled with the pivoting member, where the pivoting member is pivotable in an upward direction or a downward direction upon movement of the adjuster.

For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF PREFERRED EMBODIMENTS

Net systems are described with height adjustment system for quicker setup and for achieving a precise net height more easily. Net systems can be used as volleyball nets or tennis nets, as well as in non-sports applications. The net system may include a coarse net height adjustment system to accommodate the different net height requirements for different regulations and leagues or otherwise at a desired net height. A fine net height adjustment system is included to alter the net height in between heights obtainable with the coarse incremental height adjustments. The fine net height adjustment systems may be used for leveling the net relative to a ground base and for obtaining a more precise height than would otherwise be obtainable using only the coarse net height adjustment system. Although the fine height adjustment system may be used with the tension in the net support cable in relief, the net height of the net system is adjustable with the fine height adjustment system without relieving the net support cable tension. This can reduce the setup time by avoiding the additional steps of relieving the tension of the cable, adjusting the net to the proper height, and then re-tensioning the cable that is conventionally performed.

Figure 1:
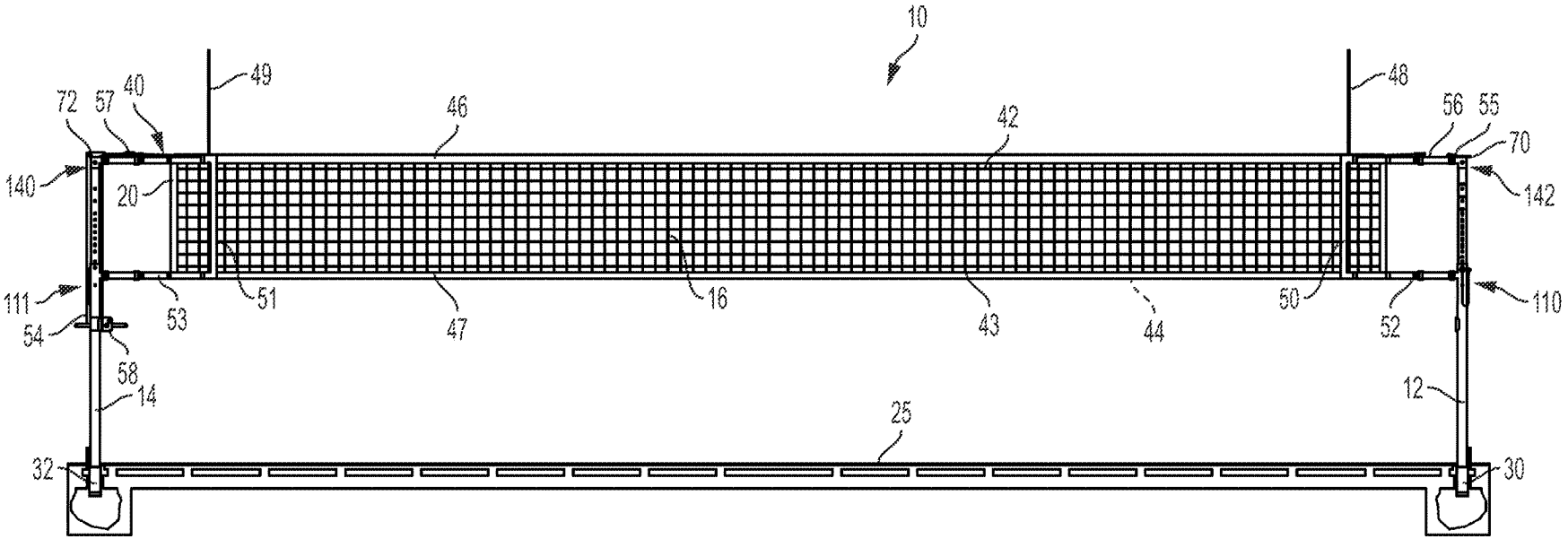
FIG. 1 illustrates a net system disposed upright relative to a ground base.
Figure 2:
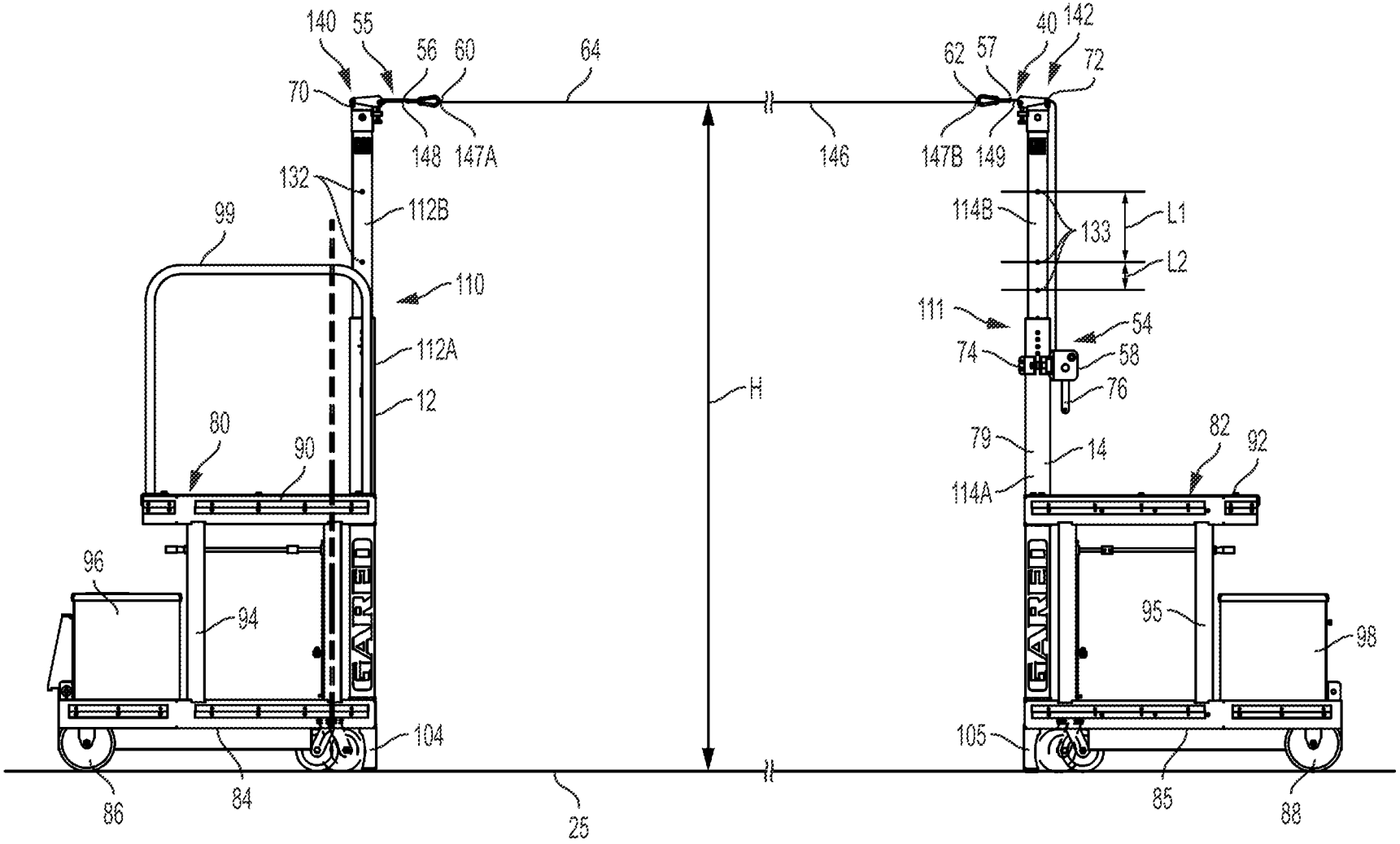
FIG. 2 illustrates another example of a net system including movable bases disposed upright relative to a ground base.

FIG. 1 depicts an example of a net system 10, used, for example but not limited to, in a sports game of volleyball. A first upright post 12 and a second upright post 14 support a net 16 at lateral first and second edges 18, 20 of the net 16, respectively, relative to a ground base 25. The lower ends 30, 32 of the respective first and second upright posts 12, 14 may be coupled to the ground base 25 (as shown in FIG. 1) or to a movable base (as shown in FIG. 2). An upper net support cable system 40 extends along an upper edge 42 of the net 16 and a lower net support cable system 44 may be extended along a bottom edge 43 of the net 16. An upper elongated sleeve 46 may be attached along the upper edge 42 of the net 16, as shown, through which the upper net support cable system 40 may be extended. A lower elongated sleeve 47 may be attached along the bottom edge 43 of the net 16, as shown, through which the lower net support cable system 44 may be extended. The upper net support cable system 40 and the lower net support cable system 44 extend outward beyond the lateral first and second edges 18, 20 of the net 16 for suspending the net 16 between the first and second upright posts 12, 14. Antennas 48, 49 and sideline markers 50, 51 may be coupled to the net 16 in alignment with the sidelines of the sports court. Additional bottom straps 52, 53, which may make a part of the lower net support cable system 44, may be coupled between the first and second upright posts 12, 14 and the lateral first and second edges 18, 20 of the net 16 along the bottom edge 43 to stabilize and provide tensioning to the net 16 along the bottom edge 43.

The net 16 may have various sizes. In one example, when the net 16 is a volleyball net, the net 16 is one meter (3.3 feet) wide between the upper and bottom edges 42, 43 and at least 9.5 meters (31 feet) in length between the lateral first and second edges 18, 20. The first and second upright posts 12, 14 may be placed one meter outside the sidelines of the volleyball court, which has a width of nine meters (29.5 feet). The height H of the upper net support cable system 40 under tension generally coincides with the net height measured at the center of the net 16 and may be set at a various heights. For example, the height H of the upper net support cable system 40 may be set to coincide with the center net height of 2.43 meters (8 feet) for men and 2.24 meters (7.35 feet) for women. When the upper net support cable system 40 is suitably tensioned such that the upper net support cable system 40 is in a fully tensioned configuration, the height of the upper net support cable system 40 measured along its body in close proximity to the lateral first and second edges 18, 20 of the net 16, that is proximate to the respective upright posts, is not permitted to exceed the height H at the center of the upper net support cable system 40 by more than a set distance, or otherwise as regulated. In an example, when the upper net support cable system 40 is maintained in the fully tensioned configuration, the height of the upper net support cable system 40 measured proximate to the connection to the upright posts is maintained relative to the center height H at two centimeters or less. In another example, the upper support cable system 40 is in the fully tensioned configuration when the first and second upright posts 12, 14 is not adjustable with the coarse height adjustment, as described below, due to increased friction between the upper and lower portions of the upright posts caused by the tensioning of the upper net support cable system 40. Other net heights are possible for other player age groups, such as but not limited to, 1.98 meters (6.5 feet), 2.13 meters (7 feet), 2.19 meters (7.2 feet), or 2.38 meters (7.8 feet).

The upper net support cable system 40, or cable system, extends between a first end 55 and a second end 54. The upper net support cable system 40 may comprise of a single element or an assembly of multiple elements coupled to one another. In one example, the upper net support cable system 40 may include a single integrated cable without the use of straps. The cable may have a core of a single metal wire member or multiple metal wire members (such as, for example, steel or other metal) with a plastic outer sleeve. Here, in the cable only example, a first looped end of the cable, corresponding to the first end 55 of the upper net support cable system 40, is coupled to the first upright post 12, and a second looped end of the cable, corresponding to the second end 54 of the upper net support cable system 40, is coupled to a winch 58 that is coupled to the second upright post 14. In alternative examples, the winch 58 may be coupled to each of the first and second upright posts 12, 14. In another example, the upper net support cable system 40, or cable system, is shown including a first lateral strap 56 and a second lateral strap 57 coupled to the ends 60, 62 of a cable 64 extending along the upper edge 42 of the net 16, as shown in FIG. 2. The straps described herein may be made of nylon material. Here, the cable 64 is extended through the upper elongated sleeve 46 such that the ends 60, 62 extend beyond the lateral first and second edges 18, 20 of the net 16. In the example shown, the first lateral strap 56 may be coupled between the first end 60 of the cable 64 and the first upright post 12. The second lateral strap 57 may be coupled between the second end 62 of the cable 64 and the winch 58 of the second upright post 14. In an alternative example, the first lateral strap 56 may be coupled between the first end 60 of the cable 64 and a winch of the first upright post 12, the second lateral straps 57 may be coupled between the second end 62 of the cable 64 and the winch 58 of the second upright post 14.

The net system 10 includes a cable mount on one or both of the first and second upright posts 12, 14. The first end 55 of the upper net support cable system 40 may be coupled to the first upright post. For example, the first end 55 may be coupled to the first upright post 12 via a first cable mount 70, as shown, or a second winch (not shown) similar to the winch 58, or may be directly coupled to the post without the first cable mount. The second end 54 of the upper net support cable system 40 may be coupled along a second cable mount 72 and to the winch 58 or a tensioning system of the net system 10. The winch 58 may include a sleeve mount 74 coupled around a lower portion 79 of the second upright post 14. The sleeve mount 74 may include two half portions sized to clamp over the lower portion 79 and configured to couple to one another with a mechanical fastener, such as a threaded bolt, making the winch a vertically adjustable winch. In particular, the second end 54 of the upper net support cable system 40 may be wound around a drum of the winch 58, and a crank 76 of the winch 58 is rotated in a first direction to increase tension to the upper net support cable system 40 up to the fully tensioned configuration. To prevent over-sagging at the center of the net 16, the winch 58 is configured to maintain the upper net support cable system 40 at a consistent tension. The crank 76 is rotated in a second direction to relieve tension to the upper net support cable system or place upper net support cable system 40 into a nontensioned configuration, as may be appreciated by one of ordinary skill in the art.

FIG. 2 is an example of a first movable base 80 coupled to the first upright post 12 and a second movable base 82 coupled to the second upright post 14. With additional reference to FIGS. 3-4, each of the bases 80, 82 includes a lower support 84, 85 which may have ground engaging members 86, 88, such as wheels or castors, to allow movement of the bases 80, 82 for setup and storage. Platforms 90, 92 may be elevated above the respective lower support 84, 85 and supported with a frame 94, 95 extending between the corresponding platforms 90, 92 and the lower supports 84, 85. The platforms 90, 92 may be used by observers or referees of the sports match. Step boxes 96, 98 may be located adjacent the respective platforms 90, 92 and at a lower elevation such that the step boxes 96, 98 can be used to stand on the platforms 90, 92. Handrails 99 may be further attached to the platform 90. The platform 90 and the lower support 84 may include channels 100A, 100B, respectively, in alignment to receive and allow the first upright post to pass through. The platform 92 and the lower support 85 may include channels 102A, 102B, respectively, in alignment to receive and allow the second upright post 14 to pass through. Portions defining the channels 100A, 100B, 102A, 102B may be fixedly attached to the first and second upright posts 12, 14 and aid in maintaining the upright posts in vertical alignment. The lower ends 30, 32 of the respective upright posts 12, 14 may engage the ground base 25 or, as shown, the lower supports 84, 85 may include a foot 104, 105 extending between the lower ends and the ground base 25.

The net system 10 may include a coarse net height adjustment system 110, 111 to accommodate the different net height requirements discussed previously. The coarse net height adjustment system 110, 111 may include each of the first and second upright posts 12, 14 including movable telescopic portions to adjust the center of the height H of the upper net support cable system 40, and ultimately the center net height. The coarse net height adjustment systems are employed when the upper net support cable system is relieved of tension. Different coarse net height adjustment systems are contemplated. For example, the coarse net height adjustment systems may be employed to set the relative position of the movable telescopic portions of the upright posts, such as but not limited to, a pin-hole coupling, as further described below, a cam device that applies a perpendicular friction pressure with the cam against the movable portion, a locking collar that applies a circumferential pressure against the movable portion, or other coarse net height adjustment systems.

In one example, each of the first and second upright posts 12, 14 includes a lower post portion 112A, 114A, respectively, telescopically movable within an upper post portion 112B, 114B, respectively. The lower post portions 112A, 114A and the upper post portions 112B, 114B can be tubular members having a cylindrical or rectangular cross-sectional shape, while other shapes are contemplated. Lower ends 116, 117 of the respective lower post portions 112A, 114A may extend to the corresponding lower supports 84, 85, as shown, or beyond the lower supports 84, 85 to the ground base 25.

Figure 3A:
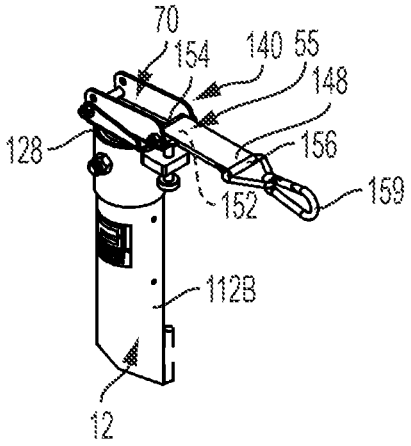
FIG. 3A is a close-up detail perspective view of an upper end of the first upright post depicted in FIG. 3.
Figure 3:
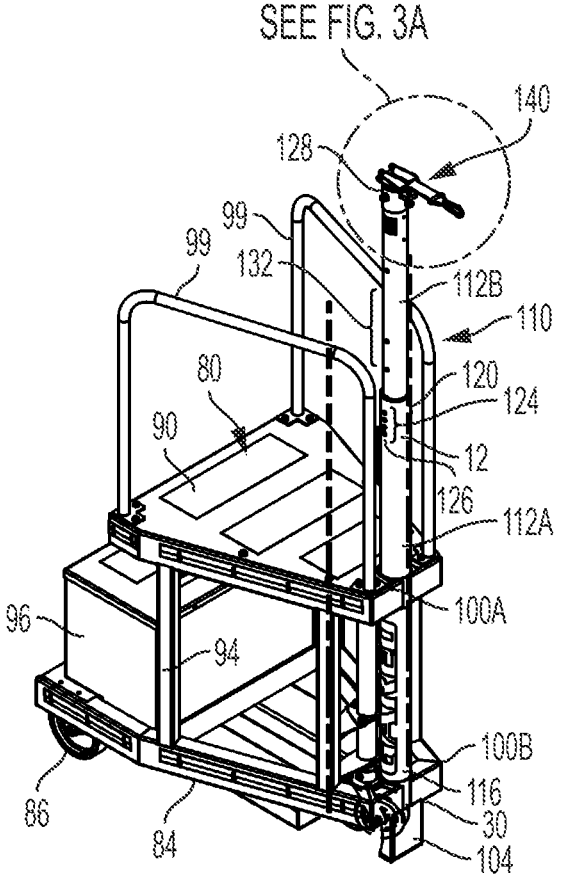
FIG. 3 is a perspective view of a first upright post coupled to a first movable base of the net system of FIG. 2.
Figure 4:
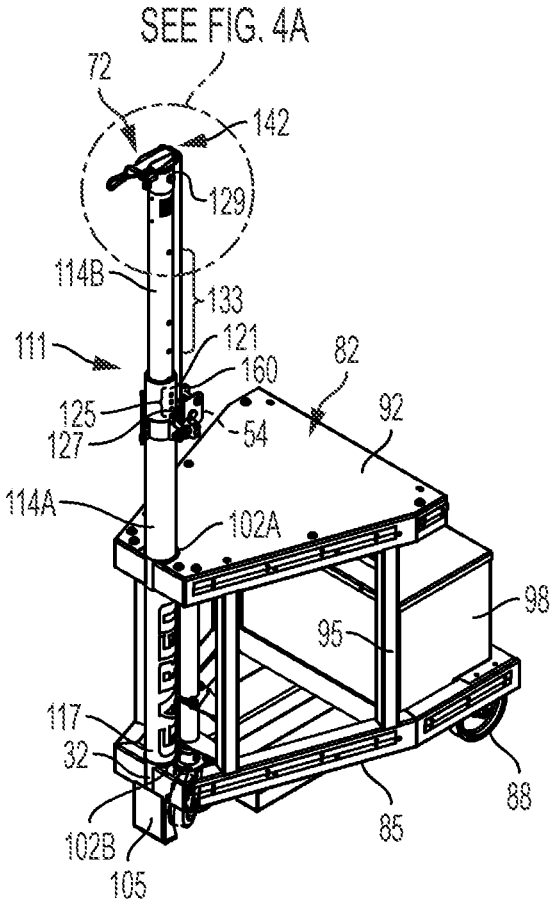
FIG. 4 is a perspective view of a second upright post coupled to a second movable base of the net system of FIG. 2.

Upper ends 120, 121 of the respective lower post portions 112A, 114A may be positioned a predetermined distance from the ground base 25. One or more first positioning pin holes 124, 125 may be extended through wall or walls of the respective lower post portions 112A, 114A. The first positioning pin holes 124 formed along opposite walls of the lower post portion 112A are in alignment with each other in order to receive a first adjustment pin device 126, as shown in FIG. 3. The first positioning pin holes 125 formed along opposite walls of the lower post portion 114A are in alignment with each other in order to receive a second adjustment pin device 127, as shown in FIG. 4. In one example, the first positioning pin holes 124 and/or 125 may be longitudinally spaced from one another at constant or varying distances.

Lower ends (not shown) of the upper post portions 112B, 114B may be received within the cavity of the corresponding lower post portions 112A, 114A. Each of upper ends 128, 129 of the respective upper post portions 112B, 114B is positionable at selective distances from the ground base 25. One or more second positioning pin holes 132, 133 may be extended through the wall or walls of the respective upper post portions 112B, 114B. The second positioning pin holes 132 formed along opposite walls of the upper post portion 112B are in alignment with each other in order to receive the first adjustment pin device 126 when the second positioning pin holes 132 are in alignment with the first positioning pin holes 124. The second positioning pin holes 133 formed along opposite walls of the upper post portion 114B are in alignment with each other in order to receive the second adjustment pin device 127 when the second positioning pin holes 133 are in alignment with the first positioning pin holes 125.

The second positioning pin holes 133 may be longitudinally spaced from one another at longitudinal distances (shown in FIG. 2 as longitudinal distances L1 and L2, but may include more). The spacing at longitudinal distances may vary, as shown in L1 and L2, or may be constant. The second positioning pin holes 132 may be longitudinally spaced from one another at the same longitudinal distances L1 and L2 as the second positioning pin holes 133.

First and second adjustment pin devices 126, 127 may be sized and shaped for insertion through one of the first positioning pin holes 124, 125 and second positioning pin holes 132, 133, respectively, when in alignment. To this end, the shape of the first positioning pin holes and the second positioning pin holes may be circular as shown or may be configured as other shapes, while the first and second adjustment pin devices 126, 127 may include a cylindrical rod. When the upper post portion 112B of the first upright post 12 and the upper post portion 114B of the second upright post 14 are moved within the corresponding lower post portions 112A, 114A to align one of the second positioning pin holes 132, 133 with one of the first positioning pin holes 124, 125, respectively, the corresponding first and second adjustment pin devices 126, 127 are inserted through the aligned positioning pin holes to set the height H at a first distance.

The first and second adjustment pin devices 126, 127 may be removed and reinserted through different positioning pin holes in order the reset the height H at another, second distance different from the first distance by a first incremental distance. The relative longitudinal distances, for example, L1 and L2, between the second positioning pin holes 132, 133 coincide with the first incremental distances of adjusted heights achieved with the coarse net height adjustment systems 110, 111. In one example, the first incremental distances may be about 25 mm (one inch) or greater. That is, the relative longitudinal distances L1 and L2 between the corresponding second positioning pin holes 132, 133 may be at least about 25 mm (one inch) or greater from one another. In another example, the first incremental distances may be at least 0.1 meter (3.9 inches).

FIG. 2 also depicts the net system 10 including fine net height adjustment systems 140, 142. The fine net height adjustment systems 140, 142 may be provided to alter the height H after the initial height is set by the coarse net height adjustment systems 110, 112. In other words, after the height H is set by one of the first incremental distances, the fine net height adjustment systems 140, 142 may be used to set the height H at distances in between each of the first incremental distances, which may allow for improved leveling of the net and for obtaining a more precise height H.

Figure 4A:
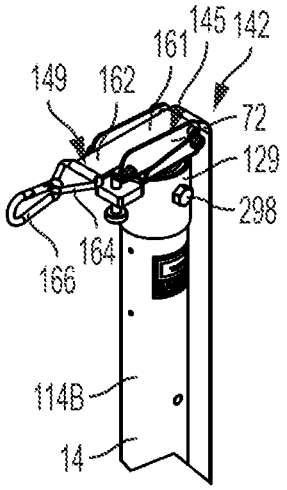
FIG. 4A is a close-up detail perspective view of an upper end of the second upright post depicted in FIG. 4.

In one example, the fine net height adjustment systems 140, 142 are included with the first cable mount 70 and the second cable mount 72, which, when used in coordination, provide height adjustments by second incremental distances, as will be described. The first end 55 of the upper net support cable system 40 may be coupled to the first cable mount 70, as shown in FIG. 3A, the second end 54 of the upper net support cable system 40 may be coupled to the winch 58, as shown in FIG. 4, and an intermediate portion 145 of the upper net support cable system 40, disposed between the first end 55 and the second end 54, is slidably coupled along the second cable mount 72, as shown in FIG. 4A. Although the upper net support cable system 40 is shown with multiple components, the upper net support cable system 40 may comprise of a single integrated element, as described previously. In the example shown, the upper net support cable system 40 includes an intermediate cable body 146 made similarly to the single integrated cable element, a first lateral strap assembly 148 coupled to a first looped end 147A of the cable body 146 and a second lateral strap assembly 149 coupled to a second looped end 147B of the cable body 146, as will be described. The looped ends may include metal rings.

FIGS. 3-3A show an example of the first cable mount 70 coupled to the upper end 128 of the upper post portion 112B of the first upright post 12, with the first end 55 of the upper net support cable system 40 coupled to the first cable mount 70. The first cable mount 70 may be coupled along different portions of of the first upright post 12. The first cable mount 70 includes a first post 152 (dashed line pointing to the position of the first 152 post hidden by the first lateral strap assembly 148) extending horizontally and perpendicular to the both the lateral direction along the suspended net and the vertical direction. In one example, the first lateral strap assembly 148 is shown including a looped end 154, coinciding with the first end 55 of the upper net support cable system 40, coupled around the first post 152 and an attachment end 156, disposed opposite to the looped end 154 of a strap body. The attachment end 156, which may also be looped, may be coupled to a metal or plastic triangular loop 158. For quick coupling, a first carabiner coupling 159 is shown positioned between the first looped end 147A of the cable body 146 and the triangular loop 158.

FIGS. 4-4A show the second cable mount 72 coupled to the upper end 129 of the upper post portion 114B of the second upright post 14, with the intermediate portion 145 of the upper net support cable system 40 coupled along the second cable mount 72. The second cable mount 72 may be coupled along another portion of the second upright post 14. The second lateral strap assembly 149 is shown including a winch end 160, coinciding with the second end 54 of the upper net support cable system 40, for coupling to the winch 58 and an attachment end 162 of a strap body 161. The attachment end 162, which may be looped, may be coupled to a metal or plastic triangular loop 164. For quick coupling, a second carabiner coupling 166 is shown positioned between the second looped end 147B of the cable body 146 and the triangular loop 164. The first and second carabiner couplings 159, 166 may include metal or plastic loop with a spring-loaded gate to quickly and reversibly connect to the respective ends of the cable body 146. The strap body 161 may be associated with the intermediate portion 145 of the upper net support cable system 40.

Figure 5:
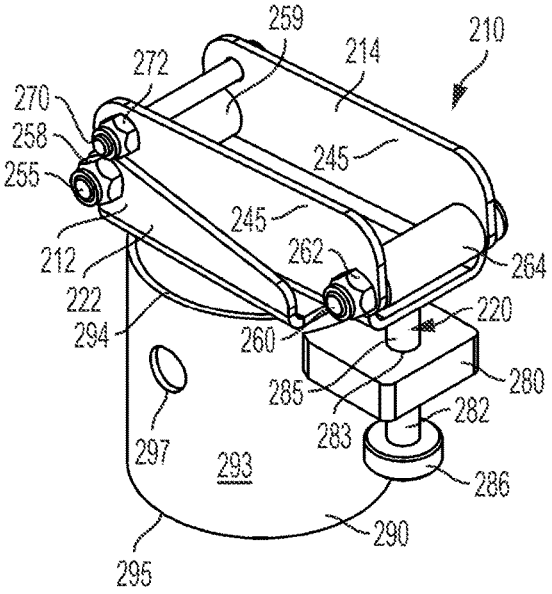
FIG. 5 is a perspective view of a cable mount with a fine net height adjustment system provided with the net systems of FIG. 1 and FIG. 2.
Figure 6:
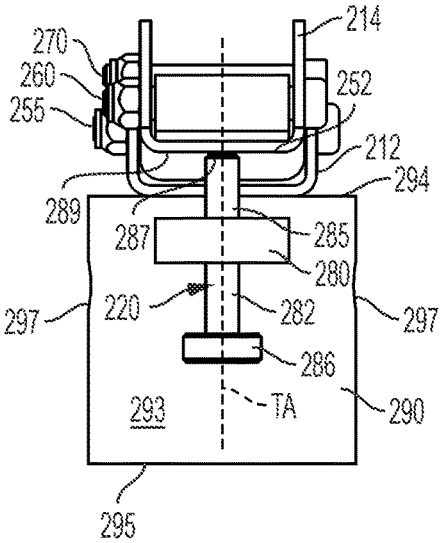
FIG. 6 is an end view of the cable mount of FIG. 5.

FIGS. 5-6 depict an exemplary cable mount (now being referred to as cable mount 210) that can be used for the first cable mount 70 and/or the second cable mount 72 for use with the net system 10. The cable mount 210 includes a mount base 212, a pivoting member 214 pivotably coupled to the mount base 212, and one example of the fine net height adjustment system, now referred to as 220, with a portion of the system 220 as will be described engaging the pivoting member 214. Movement of the fine height adjustment system 220 causes the pivoting member 214 to pivot relative to the mount base 212.

Figure 7:
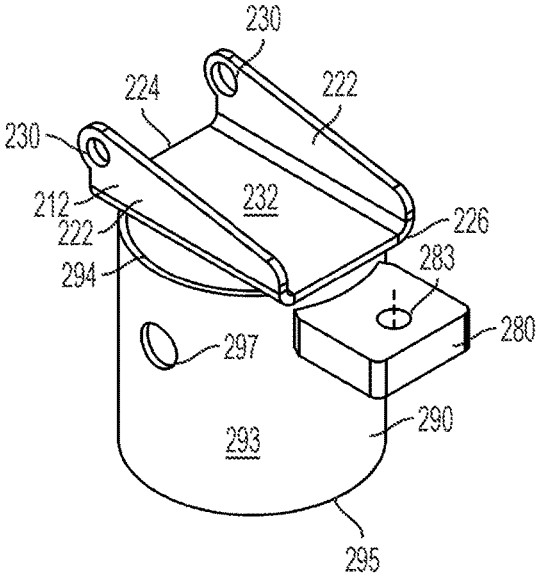
FIG. 7 is a perspective view of the cable mount of FIG. 5, depicting a mount base without a pivoting member.

With additional reference to FIG. 7, the mount base 212 includes a pair of upright base walls 222 extending upward between a lateral end 224 and a net end 226 disposed in closer proximity to the net 16 than the lateral end 224. Each of the upright base walls 222 may define pivot post openings 230 in alignment with each other for receiving a pivot post as described below. The pivot post openings 230 may be disposed in closer proximity to the lateral end 224 than the net end 226, and in some cases disposed at the lateral end. The upright base walls 222 may be tapered toward the net end 226 such that the lateral end of the upright base walls 222 is higher in elevation than the net end of the upright base walls 222. The upright base walls 222 may be coupled to the corresponding upright posts 12, 14. In one example, the upright base walls 222 extend upward from a bottom base wall 232 that is disposed laterally between the upright base walls 222 between the lateral end 224 and the net end 226. Here, the mount base 212 may be formed from a U-shaped channel integrally or with the respective walls welded or otherwise attached together.

Figure 8:
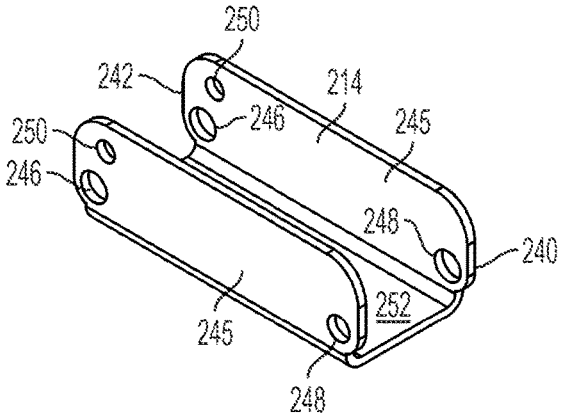
FIG. 8 is a perspective view of a pivoting member of the cable mount of FIG. 5.

With additional reference to FIG. 8, the pivoting member 214 includes a free end 240 and a pivot end 242, opposite to the free end 240, which is pivotably coupled to the mount base 212. The free end 240 is closer in proximity to the net end 226 of the mount base 212 than the pivot end 242. A pair of upright pivot walls 245 extends between the free end 240 and the pivot end 242. Each of the upright pivot walls 245 may define pivot post openings 246 that are disposed to be in alignment with each other and second post openings 248 that are disposed to be in alignment with each other. The pivot post openings 246 may be disposed in closer proximity to the pivot end 242 than the free end 240, while the second post openings 248 may be disposed in closer proximity to the free end 240. Each of the upright pivot walls may further define keeper post openings 250 disposed to be in alignment with each other. The keeper post openings 250 may be disposed above the corresponding pivot post openings 246. In one example, the upright pivot walls extend upward from a bottom pivot base wall 252 that is disposed between the upright pivot walls 245. Here, the pivoting member 214 may be formed from a U-shaped channel integrally or with the respective walls welded or otherwise attached together.

In one example, when the pivoting member 214 is coupled to the mount base 212, the upright base walls 222 are shown in FIGS. 5-6 extending outside the upright pivot walls 245. It is contemplated that the mount base 212 may be configured to fit within the upright pivot walls 245 of the pivoting member 214. The pivot post openings 246 of the pivoting member 214 are disposed in alignment with the pivot post openings 230 of the mount base 212. A pivot post 255 may be extended through the aligned pivot post openings 230, 246 to form a hinge coupling. The pivot post 255 may be sized and shaped for insertion through pivot post openings 230, 246. When the shape of the pivot post openings 230, 246 is circular as shown the pivot post 255 may be suitably sized to inhibit any slack or loose fit. The pivot post 255 is shown having threaded ends extending beyond the upright base walls 222 for coupling to threaded attachments 258, such as nuts, as shown. The pivot post 255 may comprise a core member (not shown) being sized to fit within the pivot post openings 230, 246 and a sleeve 259 having an outer diameter greater that the outer diameter of the core member. The ends of the sleeve 259 may terminate at the inner surfaces of the upright pivot walls 245.

A second post 260 is shown extended through the second post openings 248 of the pivoting member 214. The second post 260 may be an example of the post 152 of the first cable mount 70 referenced in FIG. 3A, around which the looped end 154 of the first lateral strap assembly 148 is coupled. The second post 260 may be an example of the post in the second cable mount 72 that is slidably engaged with the intermediate portion 145 of the upper net support cable system 40 or the strap body 161, as shown in FIG. 4A.

The second post 260 may be sized and shaped for insertion through second post openings 248. When the shape of the second post openings 248 is circular as shown the second post 260 may be suitably sized when inserted to inhibit any slack or loose fit. The second post 260 is shown having threaded ends extending beyond the upright pivot walls 245 for coupling to threaded attachments 262, such as nuts, as shown. The second post 260 may comprise a core member (not shown) sized to fit within the second post openings and a post sleeve 264 having an outer diameter greater that the outer diameter of the core member. The ends of the sleeve 264 may terminate at the inner surfaces of the upright pivot walls 245. The pivot and second posts 255, 260, or the sleeves 259, 264 when employed, may be configured to reduce friction losses. For example, the pivot and second posts 255, 260 and/or sleeves 259, 264 may comprise a plastic or nylon material or otherwise comprise of a lubricious surface or coating such as polytetrafluoroethylene. The sleeves 259, 264 may also be configured as a roller.

A keeper post 270 is shown extending through the keeper post openings 250 of the pivoting member 214. The keeper post 270 is another exemplary post in the second cable mount 72 that is slidably engaged with the intermediate portion 145 of the upper net support cable system 40 or the strap body 161, downstream of the engagement with the second post 260, as referenced in FIG. 4A. The keeper post 270 may be sized and shaped for insertion through keeper post openings 250. When the shape of the keeper post openings 250 is circular as shown the keeper post 270 may be suitably sized when inserted to inhibit any slack or loose fit. The keeper post 270 is shown having threaded ends extending beyond the upright pivot walls 245 for coupling to threaded attachments 272, such as nuts, as shown. The keeper post 270 may be sized smaller than the pivot post and/or sleeve.

In one example, the fine height adjustment system 220 includes an ear flange 280 and an adjuster 282, as shown in FIGS. 5-6. The ear flange 280 is shown coupled to a sleeve mount 290. Alternatively, the ear flange 280 may be securely attached to the first upright post 12 and/or the second upright post 14 in close proximity to the respective first and second cable mounts. The ear flange 280 defines a threaded opening 283 about an adjuster axis TA sized to receive a threaded shaft 285 of the adjuster 282. The threaded shaft 285 extends longitudinally from a head 286 of the adjuster 282 along the adjuster axis TA. The ear flange 280 may be oriented relative to the cable mount 210 such that the threaded opening 283 overlaps the free end 240 of the pivoting member 214. In this manner, when the threaded shaft 285 of the adjuster 282 is threadably attached with the threaded opening 283 of the ear flange 280, a tip 287 of the threaded shaft 285 engages the bottom surface 289 of the bottom pivot base wall 252 of the free end 240, as shown in FIG. 6, and the tip 287 being operable to vertically move the bottom pivot base wall 252.

Rotatable movement of the head 286 of the adjuster 282 causes the adjuster to move vertically up or downward along the adjuster axis TA depending on the rotational direction. In turn, the tip 287 engaged with the bottom surface 289 of portions of the bottom pivot base wall 252 along the free end 240 causes vertical pivoting of the pivoting member 214 relative to the mount base 212 along the pivot end 242. Due to the threaded design of the adjuster, the movement of the pivoting member 214 may be slight, for example, 0.5 mm, for the fine height adjustment system 220. The head 286 may be shaped to include a groove or protrusion or otherwise configured for receiving a complementary tool surface to facilitate turning of the adjuster 282. The periphery of the head 286 may also be roughened or grooved to improve the gripping of the head 286 if rotating manually by hand.

The sleeve mount 290 may couple to the upright post. For example, the sleeve mount 290 may be configured to couple to upper ends 128, 129 of the respective upper post portions 112B, 114B of the corresponding first and/or second upright posts 12, 14. The sleeve mount 290 includes a tubular wall 293, which may be shaped cylindrical, rectangular or other shapes. The tubular wall 293 extends between an upper end 294 and a lower end 295. The upper end 294 may be planar such that the upper end may be generally parallel with the ground base 25. As shown in FIGS. 5-6, the mount base 212 may be placed across the upper end 294, and may be fixed securely by welding or other attachment means. The lower end 295 may be sized to fit and slide over the upper ends 128, 129. The upper ends 128, 129 may have a reduced diameter to fit within the luminal diameter of the sleeve mount 290. In another example, the lower end 295 may be sized to fit and slide within the upper ends 128, 129. A pair of aligned fastener holes 297 may be defined by the tubular wall 293. The sleeve mount may be removably attached to the upper ends 128, 129 by aligning the aligned fastener holes 297 with a pair of fastener holes (not shown) defined in the upper ends 128, 129. Once aligned, a mechanical fastener 298 (shown in FIG. 4A) may extend through the aligned fastener holes of the sleeve mount and the upper end of the upper portion of the first or second upright posts. One example mechanical fastener 298 is a threaded bolt with a threaded nut threadably attached to the bolt. The sleeve mount may be also coupled to the upper end of the upper portion by welding or other known attachment means.

Figure 9A:
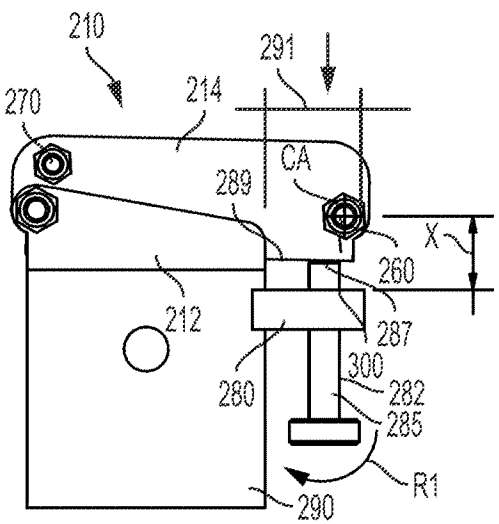
FIGS. 9A-9C depict adjustment of the fine net height adjustment system of the cable mount of FIG. 5 from an initial position, to an intermediate position, and to an extended position.
Figure 9B:
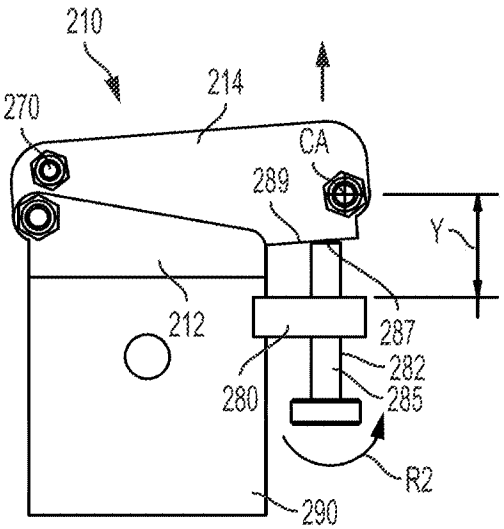
Figure 9C:
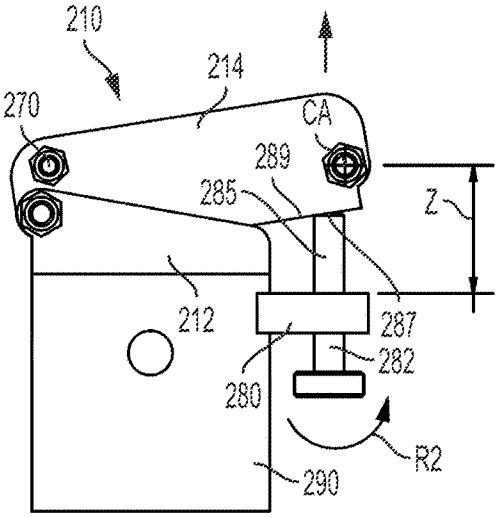

FIGS. 9A, 9B, and 9C show an example of use of the fine height adjustment system 220 with the cable mount 210 (with the upper cable the upper net support cable system 40 removed). In particular, the vertical movement of the pivoting member 214 relative to the mount base 212 is shown for achieving the fine height adjustment at second incremental distances. Depending on the fine height adjustment system employed, the second incremental distances may be constant or varying distances. For example, with a threaded adjuster, the amount of adjustment by the second incremental distance is dependent upon the amount of rotation of the adjuster and the thread size and configuration. The second incremental distance may be slight, for example, about 0.5 mm, for a slight rotation of the adjuster, to full extension due to full rotation of the adjuster to the extended position.

FIG. 9A shows an initial position of the pivoting member 214, where the vertical distance X is measured between an upper surface 300 of the ear flange 280 and the centerline axis CA of the second post 260. The ear flange 280 is shown beneath the cable mount 210 and in an overlapping relationship with an overhang portion 291 of the bottom surface 289 of the bottom pivot base wall 252. The overhang portion 291 extends beyond the net end 226 of the mount base 212. The threaded shaft 285 of the adjuster 282 is rotated in a first rotational direction R1, such as the counterclockwise direction, to move the adjuster 282 to lowest position in vertically downward position (as shown by arrow) and thus the pivoting member 214 at its initial position. The second post 260 is shown positioned below the keeper post 270. The tip 287 maintains engagement with the bottom surface 289 due to the tension of the net cable system. As shown in FIG. 3A, the looped end 154 of the first lateral strap assembly 148 coupled to the second post 260 is positioned at the vertical distance X. As shown in FIG. 4A, the intermediate portion 145 of the upper net support cable system 40 or the strap body 161 of the second lateral strap assembly 149 is engaged along the second post 260 and the keeper post 270 and then wrapped around the keeper post downwardly to the winch. The winch is rotated to tension the upper net support cable system 40 in the fully tensioned configuration.

FIG. 9B shows an intermediate position of the pivoting member 214 relative to the mount base, where the vertical distance Y is the sum of the vertical distance X and the desired distance, such as for example, 0.37 inches (9.4 mm). With the upper net support cable system 40 in the fully tensioned configuration, the threaded shaft 285 of the adjuster 282 may be rotated in a second rotational direction R2, such as the clockwise direction, to move the adjuster 282 vertically upward (indicated by the arrow) to an upward position and thus the pivoting member 214 at an intermediate position. The tip 287 maintains engagement with the bottom surface 289 due to the tension of the net cable system. With reference to FIG. 3A, the looped end 154 of the first lateral strap assembly 148 coupled to the second post 260 of the first cable mount is positioned at the vertical distance Y. With reference to FIG. 4A, the second post 260 of the second cable mount in engagement with the underneath side of the strap body 161 is moved upward to the vertical distance Y. To this end, the height H of the upper net support cable system 40 is adjusted by the difference between the vertical distance Y and distance X.

FIG. 9C shows an extended position of the pivoting member 214 relative to the mount base 212, where the vertical distance Z is the sum of the vertical distance X and the desired distance, such as for example but not limited to, 0.69 inches (17.5 mm). In this example, the pivoting member 214 can adjust by a full distance from 0 inches (0 mm) to 0.69 inches (17.5 mm). It may be appreciated that that vertical distance Z can be configured to be less than or more than 0.69 inches. In one example, the total distance between the initial position and the extended height position may be less than or equal to one of the first incremental distances. With the upper net support cable system 40 in the fully tensioned configuration, the threaded shaft 285 of the adjuster 282 is rotated in the second rotational direction R2 to move the adjuster 282 vertically upward (indicated by the arrow) to an upward position and thus the pivoting member 214 at its extended position. The tip 287 maintains engagement with the bottom surface 289 due to the tension of the net cable system. With reference to FIG. 3A, the looped end 154 of the first lateral strap assembly 148 coupled to the second post 260 of the first cable mount is positioned at the vertical distance Z. With reference to FIG. 4A, the second post 260 of the second cable mount in engagement with the underneath side of the strap body 161 is moved upward to the vertical distance Z. To this end, the height H of the upper net support cable system 40 is adjusted by the difference between the vertical distance Z and the previous distance, for example, the distance Y.

Other examples of the fine height adjustment systems are contemplated. In another example, the adjuster comprises a radial cam configuration that may be coupled along the sleeve mount. The radial cam incudes a head pivotably coupled to a flange attached to the sleeve mount, and a handle coupled to the head and vertically movable to cause the head to rotate about the pivot connection. A rotatable handle may be used instead of the vertically movable handle. The head of the radial cam is in engagement with the overhang portion 291 of the bottom surface 289 of the bottom pivot base wall 252, which functions as the cam follower. Rotation of the head of the radial cam by vertical movement of the handle causes the pivoting member to move upward or downward similar as shown in FIGS. 9A-9C. In another example, the adjuster comprises a crank device may be coupled along the sleeve mount. The crank device may include a drive shaft inserted within the sleeve mount perpendicular to the sleeve mount. The drive shaft is drivably coupled to an upright gear that drives a horizontal gear that is coupled to a vertical member, which all may be housed within the upper post portion. The upright gear may be spring loaded and include a releasable pawl for ratcheting the device. The horizontal gear may include a threaded opening threadably engaged with the threaded shaft of the vertical member. The tip of the vertical member is in engagement with the bottom surface 289 of the bottom pivot base wall 252. Rotation of the crank device in the clockwise or counterclockwise direction rotates the upright gear, driving rotation of the horizontal gear, and driving rotation of the threaded shaft of the vertical member and its vertical movement. To this end, vertical movement of the vertical member causes the pivoting member to move upward or downward similar as shown in FIGS. 9A-9C.

To set up the system, the first and second upright posts 12, 14 are vertically positioned typically within a receptor formed into the ground or the floor or with a movable base. The net 16 may be laid out in the approximate position between the first and second upright posts. The cable body 146 may be inserted into the upper elongated sleeve 46 of the net 16. When the desired net height is selected for playing, the coarse net height adjustment systems 110, 111 may be employed for height adjustment at first incremental distances. For example, the adjustment pin devices 126, 127 may be removed from the pin holes of the first and second upright posts in order to change height of the respective upper post portions 112B, 114B relative to the lower post portions. When the respective pin holes of the first and second upright posts are aligned, the adjustment pin devices may be inserted there through.

The crank of the winch 58 may be turned in the counterclockwise direction to loosen the second lateral strap assembly for attachment to the cable body 146. The winch height may also be vertically adjusted as needed. Beginning at the second upright post 14, which may also be referenced as the winch post, the second looped end 147B of the cable body 146 may be coupled to the second lateral strap assembly 149 with the second carabiner coupling 166. The second lateral strap assembly 149 is coupled along the second cable mount 72, as described previously. The first looped end 147A of the cable body 146 is coupled to the first lateral strap assembly 148 of the first upright post 12, also referenced as the end post, with the first carabiner coupling 159. The first lateral strap assembly 148 is coupled to the first cable mount 70, as described previously.

The crank of the winch 58 may be turned in the clockwise direction to begin tightening or tensioning the upper net support cable system 40 to the fully tensioned configuration and thus tensioning the net 16. The net 16 may be centered between the first and second upright posts. The first and second lateral straps 56, 57 and the bottom straps 52, 53, if employed, may be attached around the respective first and second upright posts and tighten by pulling the straps where surfaces are attached together, for example, by Velcro.

The height H of the upper net support cable system 40, and thus the net height, may be adjusted at second incremental distances to level the net 16 and to achieve the precise height with the fine net height adjustment systems 140, 142. For example, with maintaining the upper net support cable system 40 at its fully tensioned configuration, or without relieving the tension in the net, the adjuster 282 may be moved accordingly to cause vertical movement of the pivoting member 214 of the first and/or second cable mounts 70, 72. For instance, rotatable movement of the head 286 of the adjuster 282 in the clockwise direction causes the tip 287 of the adjuster to move vertically relative to the ear flange 280. Vertical movement of the tip 287 that is engaged with portions of the bottom pivot base wall 252 causes vertical movement of the second post 260 of the pivoting member 214, which is in contacting relationship with the underneath side of the strap body 161. When each of the first and second upright posts 12, 14 includes the respective first and second cable mounts, with the fine height adjustment systems, each lateral side of the net may be vertically adjusted independently and at different fine height adjustments.

It is therefore intended that the foregoing detailed description be regarded as illustrative rather than limiting, and that it be understood that it is the following claims, including all equivalents, that are intended to define the spirit and scope of this invention.

What is claimed is:

1. A sports net system, comprising a first upright post;

a second upright post comprising a tension system and a cable mount coupled to the second upright post, the cable mount including a mount base and a pivoting member pivotably coupled to the mount base; and a cable system to support a sports net, the cable system comprising a first end coupled to the first upright post, and a second end coupled to the tension system, wherein a tension of the cable system is adjustable with the tension system and an intermediate portion of the cable system disposed between the first end and the second end is slidably engaged with the pivoting member of the cable mount;

wherein the cable mount includes a fine height adjustment system comprises an adjuster, the adjuster engaged with the pivoting member, wherein an end of the pivoting member is pivotable in an upward direction or a downward direction upon movement of the fine height adjustment, the end of the pivoting member biased by the adjuster into a contacting relationship with the intermediate portion to slidably engage the intermediate portion and adjust a height of an upper support system and a corresponding height of the sports net engaged with the upper net support system, the upper net support system included in the intermediate portion of the cable system.

2. The sports net system of claim 1, wherein the first and second upright posts are adjustable to set a height of the cable system by a plurality of first incremental distances, and the cable mount is adjustable by a plurality of second incremental distances using the fine height adjustment system to set the height of the cable system, wherein a total distance of adjustment achieved by the second incremental distances is less than or equal to one of the first incremental distances.

3. The sports net system of claim 2, wherein the pivoting member includes a free end, a pivot end, and a pair of upright walls extending between the free end and the pivot end, wherein a second post is extended between the upright walls proximate the free end, wherein the intermediate portion of the cable system is slidably engaged with the second post of the pivoting member such that the height of the upper net support system and the corresponding height of the sports net engaged with the upper net support system is raised or lowered as the pivoting member is respectively pivoted in an upward direction or a downward direction and the cable system correspondingly slides with respect to the second post.

4. The sports net system of claim 3, wherein the second post comprises a lubricious surface.

5. The sports net system of claim 3, wherein the fine height adjustment system comprises a vertically movable tip engageable with the pivoting member.

6. The sports net system of claim 1, wherein the cable mount is a second cable mount, the sports net system further comprising a first cable mount coupled to the first upright post, wherein the first end of the cable system is coupled to first upright post by being fixedly coupled with the first cable mount.

7. The sports net system of claim 6, wherein the first cable mount includes a first cable mount base and a first cable mount pivoting member pivotably coupled to the first cable mount base, wherein the first end of the cable system is coupled to the first cable mount pivoting member, wherein the first cable mount includes another fine height adjustment system coupled to the first cable mount pivoting member, wherein the first cable mount pivoting member is pivotable in an upward direction or a downward direction upon movement of the another fine height adjustment system.

8. A net system, comprising a pair of upright posts, one of the upright posts comprising a first cable mount coupled thereto, the other of the upright posts comprising a tension system and a second cable mount coupled thereto, each of the first and second cable mounts including a mount base and a pivoting member pivotably coupled to the mount base;

a cable system to support a net along a ground base, the cable system comprising a first end coupled to the first cable mount, a second end coupled to the tension system, wherein the tension system is configured to place the cable system in a fully tensioned configuration, wherein an intermediate portion of the cable system between the first end and the second end is slidably engaged with the pivoting member of the second cable mount;

wherein each of the upright posts comprises a first height adjustment system configured to alter a vertical height of the cable system and the net by first incremental distances, wherein each of the first and second cable mounts includes a second height adjustment system the second height adjustment system comprising an adjuster moveably engaged with the pivoting member such that an end of the pivoting member is biased by the adjuster into slidable engagement with the intermediate portion configured to alter the vertical height of the cable system and the net by second incremental distances, wherein a total distance of adjustment achieved by the second height adjustment system is less than or equal to one of the first incremental distances.

9. The net system of claim 8, wherein, with the tension system in the fully tensioned configuration, the second height adjustment system is configured to alter the vertical height of the cable system between an initial position and an extended height position.

10. The net system of claim 9, wherein the pivoting member of each of the first and second cable mounts includes a free end, a pivot end, and a pair of upright walls extending between the free end and the pivot end, wherein a second post is extended between the upright walls proximate the free end and is in a contacting relationship with the cable system.

11. The net system of claim 10, wherein the first end of the cable system is securely coupled to the second post of the pivoting member of the first cable mount, and wherein the intermediate portion of the cable system is slidable along the second post of the pivoting member of the second cable mount.

12. The net system of claim 10, wherein the pivoting member of each of the first and second cable mounts includes a bottom wall coupled between the upright walls, wherein the second height adjustment system of each of the first and second cable mounts includes a vertically movable tip operable to vertically move the bottom wall.

13. The net system of claim 12, wherein the second height adjustment system of each of the first and second cable mounts includes a rotatable shaft threadably attached to an ear flange coupled to the respective upright post, the rotatable shaft including the vertically movable tip, wherein, upon rotation of the rotatable shaft, the free end of the pivoting member of the respective first and second cable mounts is vertically movable.

14. A fine height adjustment system for a net, the net suspendable between a pair of upright posts and a cable system coupled to the net and extendable between the upright posts, the fine height adjustment system comprising:

a mount base coupled to the upright post;

a pivoting member comprising a free end and an opposite, pivot end pivotably coupled to the mount base, a first side of the free end positioned to contacting relationship with a portion of the cable system coupled to the net; and an adjuster extending parallel with the upright post to a second side of the pivoting member, the adjuster positioned to contiguously engage with the second side at the free end and bias the first side of the free end into the contacting relationship with the portion of the cable system, wherein the first side is opposite the second side, and the pivoting member is pivotable in an upward direction or a downward direction upon movement of the adjuster to change a height of the net coupled with the cable system.

15. The fine height adjustment system of claim 14, wherein the pivoting member includes a pair of walls extending between the free end and the pivot end, and a bottom wall coupling the upright walls, wherein a second post is extended between the upright walls proximate the free end to receive the portion of the cable system and form the contacting relationship.

16. The fine height adjustment system of claim 15, wherein the mount base includes a pair of upright base walls extending between a lateral end and a net end, the upright base walls being disposed along an outside of the walls of the pivoting member, wherein a pivot post is extended between the upright base walls proximate the lateral end and the walls of the pivoting member proximate the pivot end.

17. The fine height adjustment system of claim 16, wherein the pivoting member includes a keeper post extending between the walls of the pivoting member, the keeper post being disposed above the pivot post.

18. The fine height adjustment system of claim 15, wherein the bottom wall of the pivoting member is sized to extend beyond the net end of the upright base walls to define an overhang bottom wall portion of the pivoting member.

19. The fine height adjustment system of claim 18, further comprising a sleeve mount to couple to the upright post, the mount base coupled to an upper end of the sleeve mount, wherein an ear flange is coupled to an exterior surface of the sleeve mount, the ear flange extending laterally beneath the overhang bottom wall portion of the pivoting member, the ear flange defining a threaded opening therein along a vertical axis.

20. The fine height adjustment system of claim 19, wherein the adjuster includes a rotatable shaft with an engaging tip, the rotatable shaft threadably attached with the threaded opening of the ear flange and oriented along the vertical axis, the engaging tip being in a contacting relationship with the overhang bottom wall portion, wherein, upon rotation of the rotatable shaft, the free end of the pivoting member is vertically movable by the engaging tip.

21. The sports net system of claim 1, wherein a tension of the cable system is adjustable with the tensioning system, and the pivoting member is pivotable independent of the tensioning system to adjust the height of the upper net support system and the corresponding height of the sports net engaged with the upper net support system.

22. The sports net system of claim 1, wherein the tensioning system is coupled with the second upright post at a first location, and the cable mount is independently coupled with the second upright post at a second location, the first location spaced away from the second location.

23. The sports net system of claim 1, wherein the cable mount is coupled to the second upright post at a top end of the second upright post, and the intermediate portion of the cable system extends horizontally over the cable mount and the top end of the second upright post and extends vertically in parallel to the second upright post to the second end coupled with the tension system.

24. The fine height adjustment system of claim 14, wherein the adjuster coupled with the pivoting member is maintained in contiguous contact with the second surface of the free end by a bias created by contact of the cable system with the first surface.

* * * * *